US006361650B1

(12) United States Patent
Danielsson et al.

(10) Patent No.: US 6,361,650 B1
(45) Date of Patent: Mar. 26, 2002

(54) PROCESS FOR UPGRADING OF THERMOMECHANICAL PULP TO HIGHER QUALITY PULP

(75) Inventors: Ove Danielsson, Stockholm; Bo Falk, Järfälla; Ulf Karlsson, Jököping; Kenneth Kjellström, Torup, all of (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/856,134

(22) PCT Filed: Nov. 19, 1999

(86) PCT No.: PCT/SE99/02128

§ 371 Date: Aug. 21, 2001

§ 102(e) Date: Aug. 21, 2001

(87) PCT Pub. No.: WO99/31335

PCT Pub. Date: Jun. 2, 2000

(30) Foreign Application Priority Data

Nov. 19, 1998 (SE) ..... 9803963

(51) Int. Cl.[7] ..... D21B 1/14; D21D 1/30

(52) U.S. Cl. ..... 162/28; 162/55; 241/76

(58) Field of Search ..... 162/28, 55; 241/21, 241/28, 29, 76, 77, 78, 277, 37

(56) References Cited

U.S. PATENT DOCUMENTS 4,529,137 A * 7/1985 Matthew et al. ..... 241/163
5,145,010 A * 9/1992 Danielsson et al. ..... 162/26
5,776,305 A * 7/1998 Sabourin ..... 162/23

* cited by examiner

*Primary Examiner*—Dean T. Nguyen
(74) *Attorney, Agent, or Firm*—Lerner, David, Littenberg, Krumholz & Mentlik, LLP

(57) ABSTRACT

Processes are disclosed for processing low consistency newsprint pulp including refining the pulp in a first refiner to a consistency of greater than 2%, screening the processed pulp with a slotted screen basket with a slot width of from 0.05 to 0.15 mm, with the withdrawal of the primary reject portion being greater than 50%, withdrawing the accept portion for further processing, dewatering the reject portion to provide a high consistency pulp, refining the high consistency pulp in a second refiner, screening the processed high width consistency pulp with a slotted screen basket having a slot of less than 0.15 mm, and combining the two accept portions for the further processing steps.

5 Claims, 2 Drawing Sheets

PROCESS FOR UPGRADING OF THERMOMECHANICAL PULP TO HIGHER QUALITY PULP

FIELD OF THE INVENTION

The present invention relates to a process for producing SC/LWC qualities, by upgrading TMP intended for newsprint.

BACKGROUND OF THE INVENTION

The general technique presently used for the production of high quality TMP (thermomechanical pulp) for SC/LWC (super calendared/lightweight coated) qualities is to subject the pulp to a two-stage refining process in the main processing line. These refining processes require a relatively high-energy input level and subsequent screening in two stages for selective separation of a long fiber fraction. This fraction is processed at a high specific energy input level in two high consistency-refining stages, with renewed screening between the stages. The fiber length of the high consistency refined reject fraction is optionally controlled with a finishing refining stage with low pulp consistency.

One of the problems which exist with the use of TMP newsprint qualities as SC/LWC qualities, is that the fiber distribution is unfavorable with an average fiber length which is too high, and has a proportion of coarse rigid fibers of low binding strength which is also too high.

At present, the upgrading of TMP is often effected in plants in which only a partial quantity of the TMP-production is upgraded to SC/LWC. The upgrading is effected by high consistency refining of the finished newsprint pulp or, after screening, of its long fiber fraction in one or more stages. The result of doing so is often that the pulp gets an unfavorable fiber distribution, with an average fiber length which is too high, and a proportion of rigidfibers which is also too high, with accompanying impaired surface properties of the end product, because the screening has not been sufficiently selective at prevailing screening conditions, particularly at consistencies of more than 2%.

SUMMARY OF THE INVENTION

In accordance with the present invention, these and other problems in the prior art have been solved by the invention of a process for the processing of a low consistency newsprint pulp having a consistency of less than 5% comprising refining the low consistency newsprint pulp in a first refiner to provide a processed low consistency pulp having a consistency of greater than 2%, screening the processed low consistency pulp with a slotted screen basket having a slot width of from 0.05 to 0.15 mm to provide a primary accept portion and a primary reject portion, with the withdrawal of the primary reject portion being greater than 50%, withdrawing the primary accept portion for further processing, dewatering the primary reject portion to provide a high consistency pulp, refining the high consistency pulp in a second refiner to provide a processed high consistency pulp, screening the processed high consistency pulp with a slotted screen basket having a slot width of less than 0.15 mm to provide a secondary accept portion and a secondary reject portion, and combining the secondary accept portion with the primary accept portion for the further processing. In a preferred embodiment, the low consistency newsprint pulp has a consistency of from 2% to 5%, and the refining of the low consistency newsprint pulp in the first refiner includes a specific energy input level of from 50 to 200 kWh/t.

In accordance with one embodiment of the process of the present invention, the high consistency pulp has a consistency of from 20% to 40%, and the refining of the high consistency pulp in the second refiner includes a specific energy input level of from 600 to 1400 kWh/t.

In accordance with another embodiment of the process of the present invention, the refining of the low consistency newsprint pulp in the first refiner provides a processed low consistency pulp having a consistency of greater than 2.5%, and the screening of the processed low consistency pulp utilizes a slotted screen basket having a slot width of from 0.05 to 0.12 mm.

In accordance with another embodiment of the process of the present invention, the screening of the processed low consistency pulp includes a withdrawal of the primary reject portion of greater than 55%.

The above mentioned problems have been solved in accordance with the present inventive process, by placing a low consistency refiner (LC-refiner) as a first upgrading stage in direct connection to a fractionating screen room, that includes equipment for slot screening, with a narrow slot width, of the stiff long fiber fraction. This upgrading stage, due to its position, regulates the fiber length, the fiber flexibility and the shive content of the pulp, in a particularly favorable manner for the screening process. Thus, in the inventive process for producing upgraded TMP to an SC/LWC quality, the newsprint pulp with a consistency of less than 5% is pumped to a LC-refiner, where the average fiber length is reduced by 10% to 25%, and subsequent transfer of the pulp with a consistency of more than 2% to a primary screen, which has a slotted screen basket with a slot width of from 0.05 to 0.15 mm. The pulp is divided into primary accept and primary reject portion, whereby the reject withdrawal exceeds 50%. The primary accept portion is transferred to the main line for further processing. The primary reject portion is dewatered prior to again being refined in at least one high consistency refiner (HC refiner). The refined primary reject portion is then transferred to a secondary screen which has a slotted screening basket with a slot width of from 0.05 to 0.15 mm, and is divided into a secondary accept portion and a secondary reject portion. The secondary accept portion is returned to the main line and mixed with the primary accept portion from the primary screen.

BRIEF DESCRIPTION OF THE DRAWINGS

The present invention will now be described in more detail with reference to the following detailed description, which, in turn, refers to the drawings, in which.

DETAILED DESCRIPTION

Figure 1:
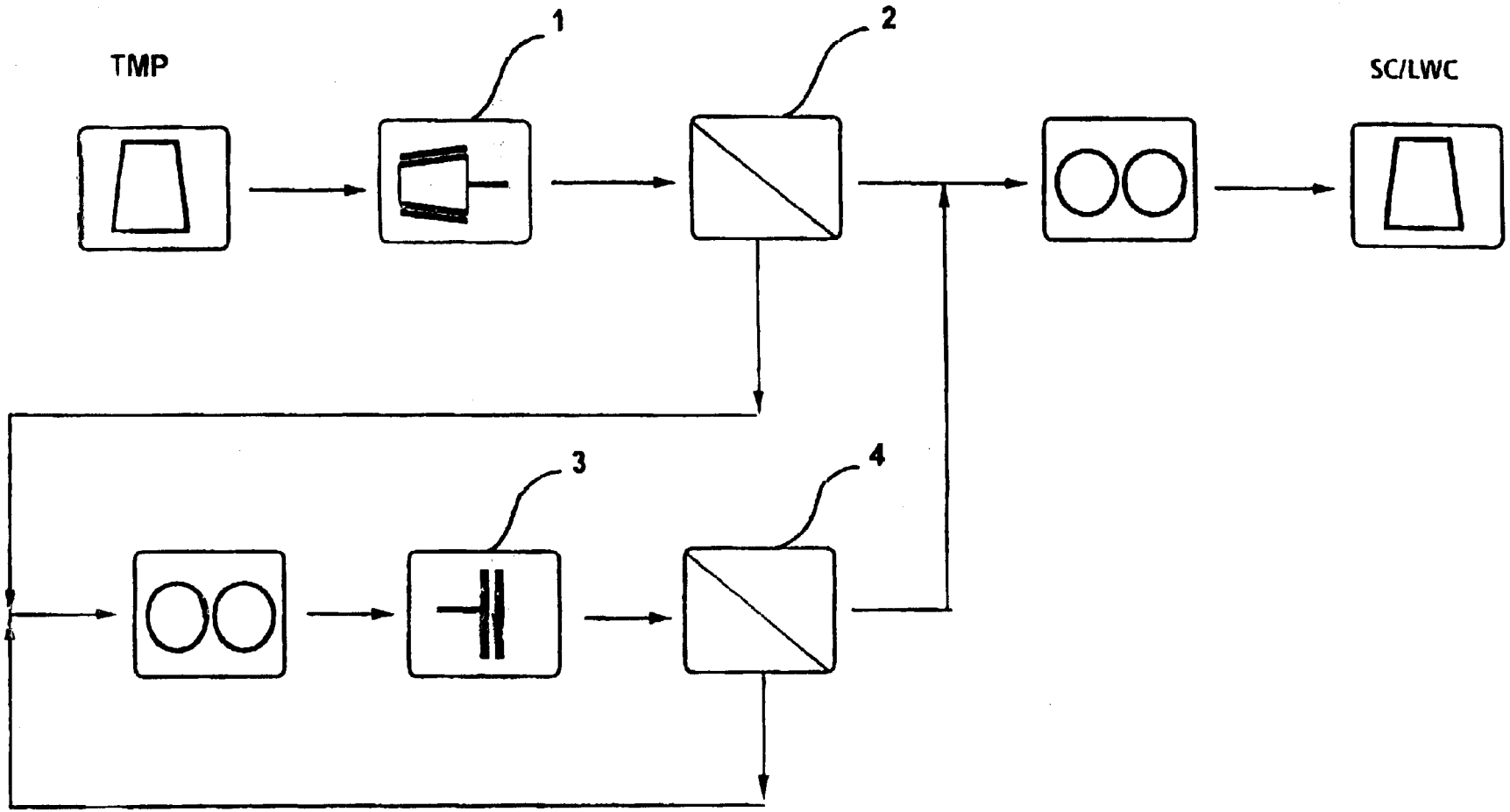
FIG. 1 is a schematic representation of a method according to the present invention.

Referring to the drawings, in FIG. 1 newsprint pulp is pumped to a LC-refiner 1, preferably a conical refiner, for refining at low pulp consistencies of less than or equal to 5%, and preferably from 2% to 5%. The average fiber length of the pulp is reduced in the refiner 1 by from 10% to 25%, at the same time that the network strength is reduced. The specific energy input level is from 50 to 200 kWh/t, and preferably from 100 to 150 kWh/t. The pulp is then immediately screened at a consistency of more than 2%, preferably more than 2.5%, in a primary screen 2 in a slotted screen basket with a slot width of from 0.05 to 0.15 mm, preferably less than 0.12 mm, with a 40% to 60% reject withdrawal or with a reject withdrawal of more than 50%, preferably more than 55%. Subsequently, the coarse fraction (the reject) is dewatered and further refined once more in an HC-refiner 3 at a high pulp consistency of from 20% to 40% and with a high specific energy input level of from 600 to 1400 kWh/t. The refined reject is screened in a secondary screen 4 with a slotted screen basket with a slot width less than or equal to 0.15 mm, whereby the reject withdrawal exceeds 50%. The secondary screen 4 accept portion is returned to the main line and mixed with the primary screen 2 accept portion. The reject pulp from the secondary screen 4 may be re-processed in the HC-refiner 3 together with the reject from the primary screen 2. Alternatively, the reject from the secondary screen 4 may be transferred from the line, and used for some other purpose. The pulp from the combined accepts from the primary screen and the secondary screen is transferred to the main line. The average fiber length of the pulp has now been reduced by from 15% to 25% and at the same time, the freeness level has been lowered by from 40 to 70 ml CSF. The density-dependent properties of the pulp have been greatly improved, with only a slight drop in tear resistance. The nature of the pulp is comparable with that which is produced in accordance with the earlier mentioned general technique, implying that the pulp is suitable for the manufacture of high-quality SC/LWC paper.

Figure 2:
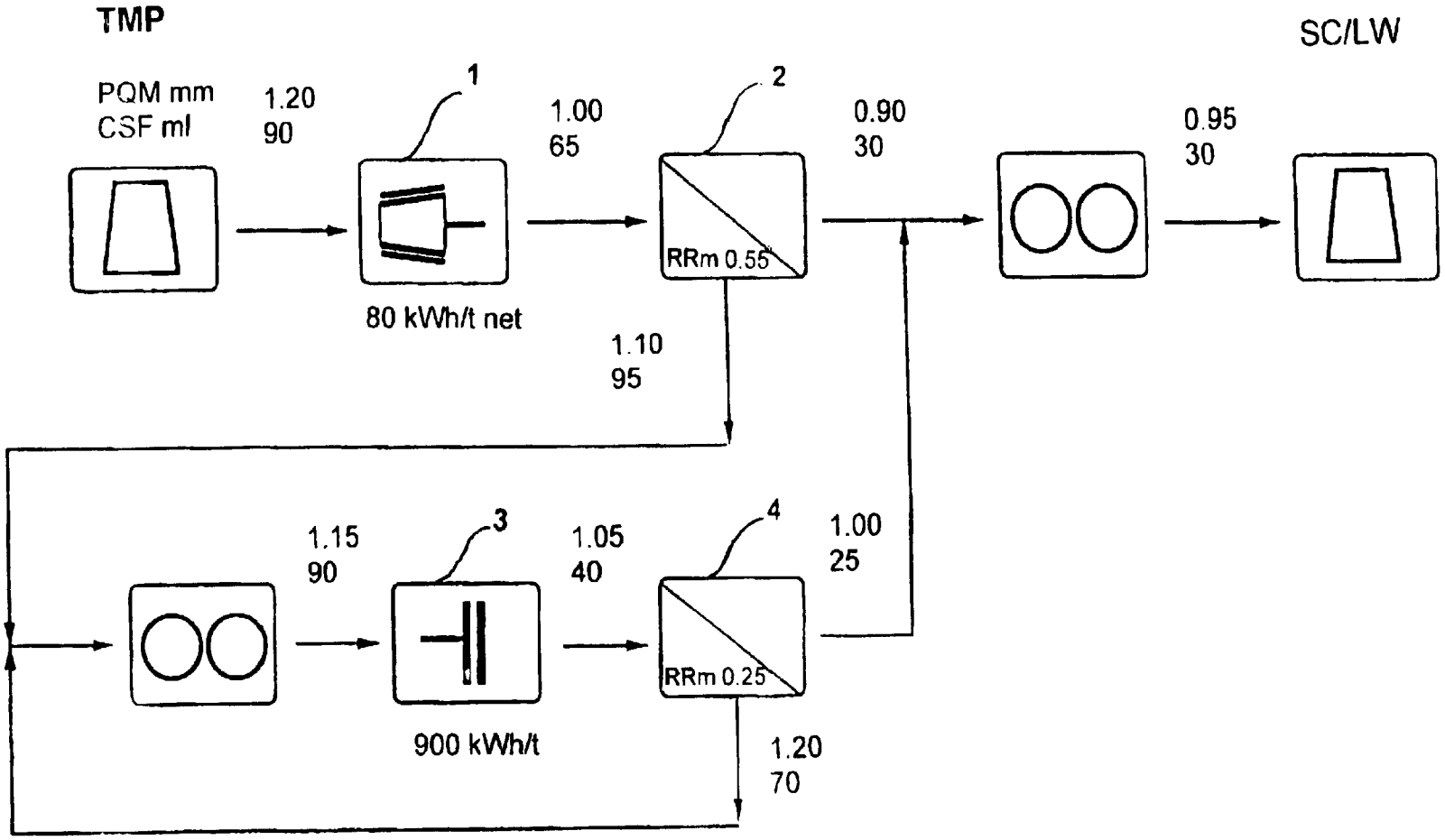
FIG. 2 is a schematic representation of a specific example of a method according to the present invention.

In the exemplifying embodiment illustrated in FIG. 2, the pulp entering the LC-refiner has a fiber length of 1.20 mm PQM and a freeness of 90 ml CSF. The fiber length of the pulp leaving the LC-refiner 1 has been reduced to 1.00 mm PQM and the freeness is now 65 ml CSF. The energy consumption in the LC-refiner is 80 kWh/t net with respect to the outgoing pulp. In the primary screen 2 the accept obtains a fiber length of 0.90 mm PQM and the reject a fiber length of 1.10 mm PQM. The combined fiber length from the primary reject and the secondary reject is 1.15 mm PQM, which is transferred into the HC-refiner. The combined reject pulp has a freeness of 90 ml CSF. The refining in the HC-refiner requires an energy input level of 900 kWh/t. The combined accepts derived from the primary screen and the secondary screen have a fiber length of 0.95 mm PQM and a freeness of 30 ml CSF. Other examples of changes in fiber length and in freeness of the pulp in the different stages are set forth in the flow sheet of FIG. 2. Table 1 shows the pulp properties before and after treating the pulp in accordance with the above exemplifying embodiment of the present invention.

TABLE 1

| | Newsprint quality Ingoing pulp | SC/LWC quality Outgoing pulp |
|---|---|---|
| LC-refiner kwh/t net Energy consumption | | 80 |
| HC refiner kwh/t Energy consumption | | 900 |
| Freeness CSF ml | 90 | 30 |
| Fibre length, PQM mm | 1.20 | 1.00 |
| BMcNett +30% | 45 | 30 |

TABLE 1-continued

| | Newsprint quality Ingoing pulp | SC/LWC quality Outgoing pulp |
|---|---|---|
| Shive content % | 0.30 | 0.01 |
| Tensile index Nm/g | 40 | 52 |
| Tear resistance mN | 1100 | 1010 |
| Porosity ml/min | 140 | 30 |

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A process for the processing of a low consistency newsprint pulp having a consistency of less than 5% comprising refining said low consistency newsprint pulp in a first refiner to provide a processed low consistency pulp having a consistency of greater than 2%, screening said processed low consistency pulp with a slotted screen basket having a slot width of from 0.05 to 0.15 mm to provide a primary accept portion and a primary reject portion, with the withdrawal of said primary reject portion being greater than 50%, withdrawing said primary accept portion for further processing, dewatering said primary reject portion to provide a high consistency pulp, refining said high consistency pulp in a second refiner to provide a processed high consistency pulp, screening said processed high consistency pulp with a slotted screen basket having a slot width of less than 0.15 mm to provide a secondary accept portion and a secondary reject portion, and combining said secondary accept portion with said primary accept portion for said further processing.

2. The process of claim 1 wherein said low consistency newsprint pulp has a consistency of from 2% to 5%, and wherein said refining of said low consistency newsprint pulp in said first refiner includes a specific energy input level of from 50 to 200 kWh/t.

3. The process of claim 1 wherein said high consistency pulp has a consistency of from 20% to 40%, and wherein said refining of said high consistency pulp in said second refiner includes a specific energy input level of from 600 to 1400 kWh/t.

4. The process of claim 1 wherein said refining of said low consistency newsprint pulp in said first refiner provides a processed low consistency pulp having a consistency of greater than 2.5%, and wherein said screening of said processed low consistency pulp utilizes a slotted screen basket having a slot width of from 0.05 to 0.12 mm.

5. The process of claim 1 wherein said screening of said processed low consistency pulp includes a withdrawal of said primary reject portion of greater than 55%.

* * * * *

UNITED STATES PATENT AND TRADEMARK OFFICE

CERTIFICATE OF CORRECTION

PATENT NO. : 6,361,650 
DATED : March 26, 2002
INVENTOR(S) : Ove Danielsson, Bo Falk, Ulf Karlsson and Kenneth Kjellström It is certified that error appears in the above-identified patent and that said Letters Patent is hereby corrected as shown below:

Title page,
Item [75] Inventors, "Jököping" should read -- Jonkoping".
Item [57] ABSTRACT,
Line 10, delete "width".
Line 11, after "slot" insert -- width --.

Column 3,
TABLE 1, "kwh/t" (both instances) should read -- kWh/t --.

Signed and Sealed this

Twenty-eighth Day of May, 2002

*Attest:*

*Attesting Officer*

JAMES E. ROGAN
*Director of the United States Patent and Trademark Office*